United States Patent [19]

Weber et al.

[11] 4,262,516

[45] Apr. 21, 1981

[54] PIERCED METAL TUBE BLANKS AND METHODS OF MAKING SUCH BLANKS

[75] Inventors: Frank Weber; Erwin Jericho, both of Sulzbach-Rosenberg; Werner Friedrichs, Amberg, all of Fed. Rep. of Germany

[73] Assignee: Eisenwerk-Gesellschaft Maximilianshutte, Sulzbach-Rosenberg, Fed. Rep. of Germany

[21] Appl. No.: 957,611

[22] Filed: Nov. 3, 1978

Related U.S. Application Data

[62] Division of Ser. No. 766,284, Feb. 7, 1977.

[30] Foreign Application Priority Data

Feb. 11, 1976 [DE] Fed. Rep. of Germany ..... 2605236

[51] Int. Cl.[3] ..... B21B 17/08; B21C 23/18; B21D 22/26

[52] U.S. Cl. ..... 72/348; 72/267; 72/256; 72/208

[58] Field of Search ..... 72/253, 273, 348, 357, 72/266, 267, 325, 256, 208, 283; 29/1.21

[56] References Cited

U.S. PATENT DOCUMENTS

| | | | |
|---|---|---|---|
| 495,245 | 4/1893 | Ehrhardt | 72/348 |
| 520,296 | 5/1894 | Cayley | 72/256 |
| 796,223 | 8/1905 | Kaub | 72/273 |
| 1,171,344 | 2/1916 | Legere | 72/267 |
| 1,314,366 | 8/1919 | Reigart | 72/267 |
| 1,347,415 | 7/1920 | Sherman et al. | 72/267 |
| 2,248,002 | 7/1941 | Layton | 72/256 |
| 2,299,105 | 10/1942 | Muir | 72/325 |
| 2,339,019 | 1/1944 | Le Tourneau | 72/266 X |
| 2,642,647 | 6/1953 | Culhane, Jr. | 29/1.21 |
| 2,739,372 | 3/1956 | Kritscher | 72/256 |
| 2,917,823 | 12/1959 | Fletcher | 72/256 |

FOREIGN PATENT DOCUMENTS

| | | | |
|---|---|---|---|
| 1099317 | 2/1961 | Fed. Rep. of Germany | 72/325 |
| 1298494 | 7/1969 | Fed. Rep. of Germany | 72/208 |
| 1169519 | 12/1958 | France | 72/267 |
| 1385389 | 12/1964 | France | 72/267 |
| 334020 | 11/1958 | Switzerland | 72/325 |
| 102898 | 1/1917 | United Kingdom | 72/253 |

*Primary Examiner*—Lowell A. Larson
*Attorney, Agent, or Firm*—Lawrence I. Field

[57] ABSTRACT

A pierced metal blank having an annular cross-section with one end closed and the other end open for use in the manufacture of seamless tubes has a bore with portions of different diameters, the portion of larger diameter, which is adjacent the open end of the blank has a wall thickness which is less than that of the portion of smaller diameter which is adjacent the closed end of the blank. Preferably there is a conical transition between the two portions of different diameters. The blank is preferably made from a metal billet of square cross-section in a substantially cylindrical piercing mould by piercing the billet within the mould by means of a stepped mandrel which presses the material of the square billet outwards into contact with the cylindrical wall of the mould.

1 Claim, 4 Drawing Figures

PIERCED METAL TUBE BLANKS AND METHODS OF MAKING SUCH BLANKS

This is a division of application Ser. No. 766,284, filed Feb. 7, 1977.

This invention relates to pierced metal blanks having an annular cross-section and a stepped internal diameter for use in the manufacture of seamless tubes. The invention is especially applicable to the manufacture of precision tubes such as those from which the bearing rings of ball bearings are made.

Seamless tubes can be produced by diagonal rolling, Pilger rolling, rolling in two-high rolling mills or on a push bench. These various methods all have the common feature that a substantially cylindrical pierced metal blank is fitted over a mandrel and the pierced blank is stretched and deformed to a tube bloom by rolling it over the mandrel. The necessary pierced blanks can be produced by diagonal rolling or by punching of billets in a press. The formation of the blank by piercing by diagonal rolling calls for cylindrical billets and is therefore not suitable for the direct use of continuously cast billets. Having regard to the great economic advantages of continuous casting, piercing in a punching press has therefore now regained importance in the production of pierced blanks from continuously cast billets of square cross-section.

In piercing in a punching press, a four-sided billet, previously heated to the required deformation temperature, is usually placed in a circular mould and is brought to the required shape of the pierced blank which is closed at one end, by driving a cylindrical piercing mandrel into the billet in the mould. The billet cross-section is so selected that the longitudinal corners of the billet rest substantially in contact with the internal face of the wall of the mould and, when the piercing mandrel is driven in, the four cavities, of segment-shaped cross-section, between the longitudinal faces of the billet and the wall of the mould are filled out with the material of the billet. During piercing, the objective is as far as possible to limit the flow of material to the lateral filling out of the mould cavity and as far as possible to avoid a flow of material counter to the pressing direction. When a flow of material counter to the pressing direction occurs, known as ascending piercing, this is associated with higher pressing forces and in particular with increased wear of the mould.

To ensure filling of the mould and the production of a pierced blank of circular cross-section, the diameters of the mould and of the piercing mandrel should be in a ratio of approximately 1.8:1. A further limitation arises from the fact that the ratio of billet length to tube diameter and mandrel diameter should not exceed 5:1 and 7:1 since otherwise there is a risk of the piercing mandrel running laterally out of line as it is driven into the billet, resulting in eccentric piercing. This is a serious disadvantage, in that it is almost impossible to produce tubes of uniform wall thickness from eccentrically pierced blanks.

The aforementioned dimensional relationships also set a limit to the length of the finished tube produced from the blank. A further disadvantage lies in the fact that, for each different tube diameter, the use of a correspondingly dimensioned square billet or a mould corresponding to the billet cross-section is necessary.

To enable seamless tubes of greater length or wall thickness to be manufactured, in spite of the aforementioned dimensional relationships, it is proposed in German Patent Specification No. 1,298,494, that a pierced blank having a stepped internal diameter be used. In a pierced blank of this type which has a uniform wall thickness throughout, the bore comprises, starting from the closed end, a cylindrical head portion having a diameter equal to the internal diameter of the finished tube, an adjoining conical transition, and a cylindrical main portion having a larger diameter than the internal diameter of the finished tube. Having regard to the uniformity of the wall thickness over its entire length, the pierced blank has an external diameter which varies according to the internal diameter, that is it tapers in a stepped manner from the open to the closed end.

In order to satisfy the requirement, hitherto considered essential, of a wall thickness which is uniform over the whole length of the pierced blank, a mould having a correspondingly stepped internal diameter is necessary. Such a mould is understandably more expensive than a cylindrical mould. It furthermore suffers from the disadvantage that it is subjected in the conical transition to more intense wear, because the square billet introduced into the mould bears at the start of pressing with virtual point contact against the conical surfaces and consequently a considerably higher loading is applied in this region, when the piercing mandrel is driven in, than in the remainder of the mould. Moreover, in the lower, that is the narrowest part of the mould, pressing of the billet material in a direction parallel to the axis occurs together with undesired ascending piercing involving a flow of material counter to the pressing direction.

The object of the present invention is, while retaining the advantages achievable with a pierced blank having a stepped internal diameter, to avoid the aforementioned disadvantages and in particular to provide a pierced blank which can be manufactured with reduced wear of the mould and increased production efficiency, while using different piercing mandrels having different tube and head diameters, but using the same mould, the blanks being formed from billets of uniform square cross-section.

The invention is based on the discovery that, contrary to the hitherto held view, no great importance needs to be attached to a uniform wall thickness of the pierced blank over its entire length.

According to this invention, we provide a pierced metal blank having an annular cross-section, one end closed, the other end open and a stepped internal diameter for use in the manufacture of seamless tubes, wherein the wall thickness of the blank in the portion of larger internal diameter adjacent the open end is less than in the portion of smaller internal diameter.

Thus, in a pierced blank in accordance with this invention, the wall thickness consequently increases at the reduction in internal diameter, that is to say from the open towards the closed end of the blank.

Since the pierced blank in accordance with this invention, apart from a slight conicity to facilitate ejection from the mould, is externally cylindrical, the invention makes it possible to produce tubes of different internal diameters from square billets all of the same size without changing the mould. When making blanks for the production of tubes of different internal diameters, it is therefore only necessary for identical square billets to be pierced by piercing mandrels having correspondingly differing diameters of the piercing mandrel head.

The invention also consists, according to another of its aspects, in a method of making a pierced blank in accordance with the invention wherein a metal billet of square uniform cross-section is placed in a substantially cylindrical piercing mould and is pierced by pressing a stepped mandrel axially into the billet in the mould, the material of the billet being pressed outwards into contact with the mould by the pressing of the mandrel into it.

Preferably, the pierced blank in accordance with the invention has an internal diameter ratio of D:d of from 1.02:1 to 2:1, where D is the diameter of the cylindrical part of the bore adjacent the open end of the blank and d is the diameter of the cylindrical part of the bore adjacent the closed end, and a conical transition extends between the two cylindrical portions of the bore. Preferably, the internal diameter ratio is however 1.5:1. The larger internal diameter D is adapted to the diameter of the mould and ensures, in the corresponding portion of the mould, a piercing action which only forces the billet material outwards transversely to the direction of pressing, that is without any flow of material in the axial direction. In the region also of the conical transition and of the piercing mandrel head where the bore has a diameter d, no substantial axial flow of material occurs. This is in contrast to the punching out of a pierced blank having a uniform wall thickness over its entire length, since in the formation of a blank in accordance with the invention, the square billet rests, right from the start, upon the end of the mould and is substantially in contact over the entire length of its corners with the mould wall. Also, because of this, the risk of sideways deflection of the piercing mandrel is quite considerably reduced. To this may be added the fact that, not only the mould but also the piercing mandrel is subjected to considerably less wear in the region of the piercing mandrel head and of the transition, because the wear decreases by the extent to which the piercing action results in the flow of the material of the billet only transversely to the pressing direction.

Particular advantages are obtained if, in accordance with further preferred features of the invention, there is a transition between the portions of larger and smaller diameter and the axial length l of the transition and the axial length L of the portion of smaller internal diameter d satisfy the relationship $$L:l = 1:1 \text{ to } 5:1$$

and/or $$L:d = 0.2:1 \text{ to } 5:1.$$

If these conditions are satisfied, then the pierced blank can be roughed with high deforming forces, for example on a preliminary push bench of short length or in an extrusion press.

The use of considerably higher deforming forces are possible when the above conditions are satisfied without risk of tearing off of the closed end of the pierced blank if the intermediate stretching or drawing of the blank is carried out with a stepped mandrel, which fits against the wall of the bore of the blank only in the portion of smaller diameter and/or of the transition. Since, during roughing, the mandrel bears predominantly with its conical transition against the pierced blank and consequently in this region the deforming forces are also transmitted, there is no longer a risk of tearing away of the closed end of the pierced blank.

As a further advantage, the thickness of the closed end can be reduced. This leads to smaller cropping losses. Normally, the thickness of the end must be sufficient to withstand the maximum deforming force.

This applies also to final ramming and drawing of the blank during subsequent tube production by means of a stepped mandrel, since the saving of material resulting from the thinner closed end of the pierced blank is greater than the loss of material associated with the reduction in diameter in the forward part of the mandrel and the accompanying larger wall thickness in this part of the blank.

When using a stepped mandrel, there is perferably an annular gap between the cylindrical main part of the mandrel, that is the part of larger diameter situated behind the conical transition and the corresponding cylindrical larger part of the bore, so that there is considerably less friction between the material of the pierced blank and the mandrel during roughing. This leads to a saving in drawing force of up to 30%.

An example of a blank and of a method of making it in accordance with the invention will now be described with reference to the accompanying drawings, in which.

Figure 1:
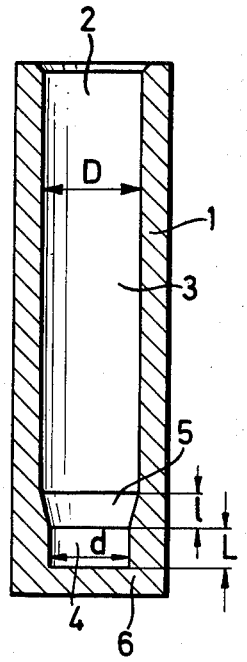
FIG. 1 is a diagrammatic axial section of the blank.
Figure 2:
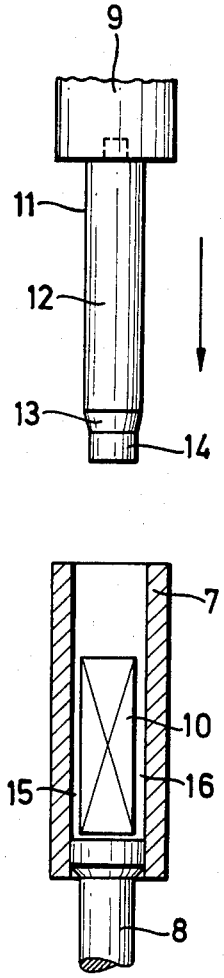
FIG. 2 is a diagrammatic representation of a mould with a four-sided billet therein and a piercing mandrel in a starting position, before forming the blank.
Figure 3:
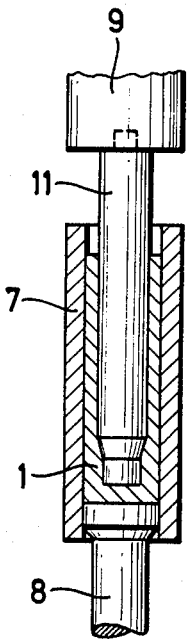
FIG. 3 is a view similar to FIG. 2, but with the piercing mandrel in its final position after piercing; and, FIG. 4 is a diagrammatic axial section of the pierced blank shown entering a preliminary push bench.
Figure 4:
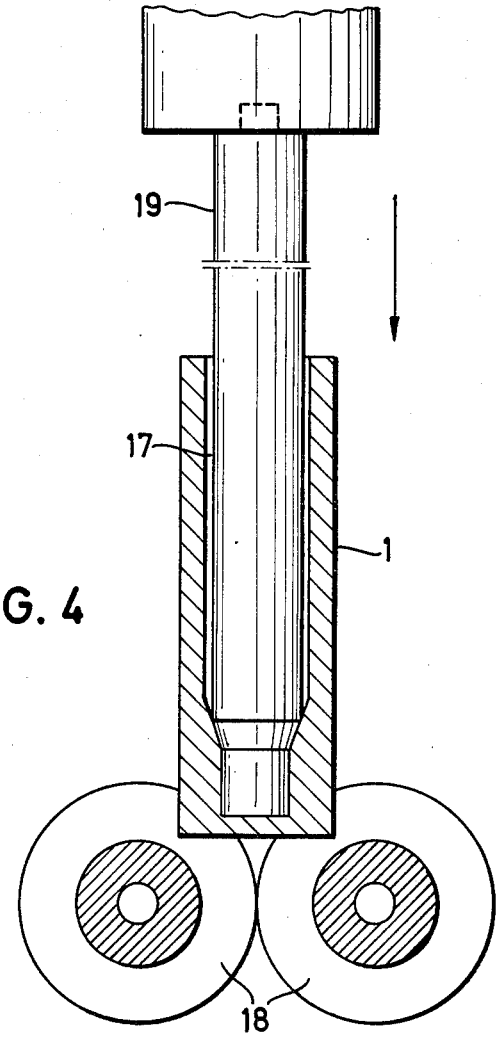

A pierced blank 1 of annular cross-section comprises a central bore 2, which is cylindrically shaped in a main portion 3 of larger diameter and has a head portion 4 of smaller diameter and a conical in a transition 5. Consequently, the wall thickness is greater in the region of the head portion 4 and the transition 5 than in the region of the main portion 3. Corresponding to the wall thickness, the piercing diameter decreases from the open end towards the closed end from D in the portion 3 to d in the head portion 4. The head portion 4 has an axial length L and the transition 5 an axial length l.

The pierced blank as illustrated in FIG. 1 is made from a square hot metal billet 10, using a stepped piercing mandrel 11 in a conventional punching press, comprising a mould 7, an ejector 8 and a pressing plunger 9. The piercing mandrel 11 has a cylindrical main part 12, a transition 13 and a piercing head 14, corresponding the shape of the bore 2.

When piercing a conventional square billet 10, which has its longitudinal corners substantially in contact with the inner wall of the cylindrical mould 7 and its end face against the ejector 8, the piercing mandrel 11 penetrates, after a slight initial banking-up of material, into the billet and thus displaces the material of the billet transversely to the pressing direction and radially outwards into spaces 15 and 16, of segment-shaped cross-section, between the longitudinal faces of the billet and the wall of the mould.

The finished pierced blank can be shaped in a push bench by means of a mandrel 19, which is stepped in a manner similar to the piercing mandrel and is mounted at the forward end of a pressing plunger. The shaping or roughing can of course alternatively be carried out on an extrusion press. In either case, the pierced blank permits the use of high deformation forces, because the transference of force from the mandrel to the blank takes place essentially in the region of the conical transition 5 as well as through the end 6. This is especially the case when the diameter of the main part of the mandrel is smaller than the diameter D of the bore, so that there is an annular clearance. The push bench is equipped with a roll stand 18.

The pierced blank 1 is pushed into the roll stand 18 by means of the mandrel 19 and is drawn over the mandrel between the rolls with an accompanying reduction in cross-section. A tube bloom of from two to five meters in length is thus produced, which can then be finally drawn if desired using a stepped mandrel rod, on a push bench to a length of, for example, from ten to thirty meters. The push bench then requires considerably fewer roll stands than is usual and/or it permits the production of longer tubes.

In an operating test, square billets of dimensions 200×200×1000 mm were pierced in a cylindrical mould having an internal diameter of 282 mm using various different stepped piercing mandrels having a diameter D of the main part of 165 mm and differing head diameters d of 110, 130 and 160 mm. The length L of the cylindrical head part was in each case 100 mm and the axial length l of the transition in each case was 80 mm. By using the aforementioned piercing mandrels, it was possible for pierced blanks of 1000 mm length to be produced with a wall thickness of the main portion 3 of about 58 mm.

The pierced blanks were roughed in a preliminary push bench comprising a number of roll stands and mandrels which differed from the aforementioned piercing mandrels only in that the diameter of their head parts was 145 mm. Consequently, there was an annular gap of width 10 mm between the main portions of the mandrels and the inner wall of the pierced blank. It was possible with considerably reduced application of force to produce, on the preliminary push bench, roughed tube blooms of length approximately 2 m to approximately 4 m, and these were then finally drawn with a reduced application of force on a push bench.

We claim:

1. A method of making a seamless tube comprising the steps of:

placing a heated metal billet of square uniform cross section in a substantially cylindrical piercing mold of uniform inner diameter;

piercing said billet by pressing a first stepped mandrel axially into said billet in said mould; and pressing metal of said billet radially outwards into contact with said mould as said mandrel is pressed into said billet whereby a pierced metal blank having an annular cross section of uniform outer diameter is formed including a peripheral wall defining a bore, there being an opening at one end of said bore and wall means closing an opposite end of said bore, the portion of said peripheral wall adjacent said opening being of larger diameter and smaller radial thickness and the portion of said peripheral wall adjacent said wall means closing the opposite end of said bore being of smaller diameter and larger radial thickness, and there being a conical transition between said portion of larger diameter and said portion of smaller diameter; and said method comprising further the step of mounting said pierced metal blank on a second stepped mandrel and drawing said pierced metal blank by means of said second mandrel through tube forming means to form said tube, said second mandrel which is stepped having an end portion with a diameter corresponding to said portion of smaller diameter, fitted against said portion of smaller diameter and a portion of said conical transition but not against said portion of larger diameter when said pierced blank is mounted on said second mandrel for drawing the same to form said tube.

* * * * *